US005725946A

United States Patent [19]

Fukushima et al.

[11] Patent Number: 5,725,946

[45] Date of Patent: Mar. 10, 1998

[54] RECORDING PAPER

[75] Inventors: Norio Fukushima; Michiko Okamoto; Yoshio Yoshida; Tsuyoshi Yasuda; Yoshihiro Kuroyama, all of Tokyo, Japan

[73] Assignee: Nippon Paper Industries, Co., Ltd., Tokyo, Japan

[21] Appl. No.: 623,746

[22] Filed: Mar. 29, 1996

[30] Foreign Application Priority Data

Mar. 31, 1995 [JP] Japan ..... 7-100628
Apr. 19, 1995 [JP] Japan ..... 7-117810

[51] Int. Cl.[6] ..... B41M 5/00

[52] U.S. Cl. ..... 428/342; 428/195; 428/211; 428/331; 428/447

[58] Field of Search ..... 428/195, 211, 428/342, 331, 447; 347/105

[56] References Cited

U.S. PATENT DOCUMENTS 4,770,934 9/1988 Yamasaki et al. ..... 428/331
4,915,923 4/1990 Ogawa et al. ..... 423/335
5,041,328 8/1991 Akiya et al. ..... 428/212
5,397,619 3/1995 Kuroyama et al. ..... 428/141
5,413,843 5/1995 Mann et al. ..... 428/211

FOREIGN PATENT DOCUMENTS 0 379 964 1/1990 European Pat. Off. ..... 428/195
0 493 100 12/1991 European Pat. Off. ..... 428/195

*Primary Examiner*—Bruce H. Hess
*Attorney, Agent, or Firm*—Millen, White, Zelano, & Branigan, P.C.

[57] ABSTRACT

A recording paper having a recording layer comprising synthetic silica and an aqueous binder as its principal components, said layer being formed on at least one surface of a base paper and the amount of said layer lying within the range of 0.5–4.0 g/m$^2$ in terms of solids on each surface on which said layer is formed, wherein either the critical surface tension of said recording layer surface ($\gamma_c$) lies within the limits $32 \leqq \gamma_c \leqq 42$ dyne/cm or the contact angle measured using water lies in the range of 100°–120°, or alternatively, the critical surface tension of said recording layer surface ($\gamma_c$) lies within the limits $32 \leqq \gamma_c \leqq 42$ dyne/cm and the contact angle measured using water lies in the range of 100°–120° is disclosed.

16 Claims, No Drawings

RECORDING PAPER

FIELD OF THE INVENTION

This invention relates to a recording paper, and more specifically, to a recording paper which provides excellent recording quality when ink jet recording is performed using water-based inks of low surface tension, and which is also suitable for use as an electrophotography transfer paper.

BACKGROUND OF THE INVENTION

In ink jet recording, fine ink drops ejected by a wide variety of mechanisms are made to adhere to a recording material to form a dot image thereon. In contrast with a dot impact recording-system, the ink jet recording is noiseless, and enables easy formation of full color images and high-speed printing.

The ink used for ink jet recording, on the other hand, is usually water-base ink using a direct dye or an acid dye. Therefore, it has poor drying properties.

Thus, the paper used in the ink jet recording system is required to have the following properties of:

(1) enabling high-speed drying of the ink adhering thereto, (2) ensuring high optical density in the images printed thereon, (3) inhibiting ink dots from spreading (or running), (4) ensuring a dot shape very close to round, and so on.

In recent years, with the development of high precision full color ink jet printers, other techniques are being developed to match this technology, e.g. making paper dry rapidly after printing by using ink of low surface tension with a higher penetration. Recording paper that can be used with such low surface tension inks is therefore required, and in particular, recording paper with the texture of ordinary paper having recording properties close to that of conventional coated paper.

However, when ink jet recording using the above mentioned ink of low surface tension was carried out on conventional high-grade ink jet recording papers of coated paper type or on a widely used ink jet recording papers of plain paper type, the ink dots formed were too diffuse or recording density decreased leading to a decline of recording quality.

A coated recording paper whereof the water absorption as measured by J. TAPPI test method No. 51, and the contact angle with water as defined in JIS K 3211, are within specified ranges has been proposed (Tokkai Hei 5-96844 (Koho)), and an ink jet recording paper for recording with ink of surface tension not exceeding 40 dyne/cm has also been proposed (Tokkai Hei 5-254239 (Koho)).

However, in the case of both of these recording papers, when ink jet recording was performed by causing drops of water-based ink having a surface tension in the range of 30–45 dyne/cm to adhere to the paper, the ink not only penetrated the recording paper in a very short time but also spread over the surface of the layer. The ink dots formed were therefore too diffuse and recording quality was poor, in addition to which the surface did not feel like ordinary paper.

Ordinary paper made from pulp supporting an inorganic material which is insoluble or difficultly soluble in water, this material being suspended in the pulp fibers, has also been proposed for use as ink jet recording paper (Tokkai Hei 6-183136). However, the ink dots are formed too large and cause leathering, and as the ink penetrates too deeply in the paper, recording density decreases leading to a decline of recording quality.

If the Steckigt sizing degree of recording paper is increased in an effort to resolve these problems, the penetration of the ink is suppressed too much so that the ink remains on the paper surface and causes smudging. Also, some of the dye components selectively penetrate the paper so that its color rendering properties change, and ink crawling occurs in fully printed recording areas. Hence, an ink jet recording paper of ordinary paper type which, when a water-based ink of low surface tension was caused to adhere to it, gave a satisfactory image of high recording quality, was not yet known in the art.

When it was attempted to use such an ink jet recording paper having a high sizing degree suitable for use with low surface tension inks as a transfer paper for electrophotography, anchoring of toner to the paper was poor, which caused toner fixing properties to decline. Also, as the frictional coefficient decreased, sticking of sheets tended to occur, impairing paper transport properties and preventing use of the paper for electrophotography.

A recording paper suitable for use both as a recording paper for ink jet recording and as a transfer paper for electrophotography, therefore still had not been discovered.

To improve the waterproof properties of print produced by ink jet printers, the water-soluble dyes used in inks are made more difficultly soluble by replacing sulfo groups in the dye with carboxyl groups (R. W. Kenyon, 9th International Congress on Advances in Non-Impact Printing Technologies/Japan Hardcopy '93, p. 279 (1993)).

As carboxyl groups are usually weakly acidic, under alkaline conditions dissociation is promoted so that the dye dissolves, but under relatively strongly acidic conditions, it is present as a free carboxylic acid so that dissolution is prevented. The improved waterproof properties of the dye are due to this principle. The dye is dissolved in ink of comparatively high pH, but after printing when the dye adheres to paper, as the pH of the paper surface is relatively low, the dye is present as the free acid and is therefore rendered difficultly soluble. Such dyes which have been rendered difficultly soluble are described together with their chemical structure in the aforementioned reference in the literature, and they all possess carboxyl groups.

Of these dyes, some possess both carboxyl groups and sulfo groups, but it is the solubility of the carboxyl groups which varies due to the change of pH before and after printing.

Since dyes which possess carboxyl groups react strongly with alkaline earth metal ions, changes of color rendering properties easily occur, and salts which are difficultly soluble in water are easily formed, if recording is performed on a recording paper containing salts of alkaline earth metals as fillers.

In the event of such a change of color rendering properties, the print quality of printed documents obviously deteriorates, and if a difficultly soluble salt is produced, a metallic gloss appears which also impairs print quality.

In recent years, the use of neutral paper has become more widespread replacing the acidic paper which was mainly used conventionally. This neutral paper comprises calcium carbonate as a filler, and is known as calcium carbonate paper. When the aforesaid water-resistant inks were used on this neutral paper, it was therefore a frequent occurrence that the calcium carbonate in the paper reacted with the aforesaid dye comprising carboxyl groups, causing a change of color rendering properties and a deterioration of print quality.

Although it is attempted to improve these defects by providing a recording layer on neutral paper, in the case of a coated paper with the texture of ordinary paper being lightweight coated of approximately 7 g/m$^2$ or less on a calcium carbonate paper which is used as a base paper, the coated layer did not suffice to completely cover the base paper so that the same deterioration of print quality occurred as mentioned hereinabove.

Moreover, when a relatively strongly alkaline salt such as calcium carbonate was used as a filler, the carboxyl groups in the dye tended to dissociate even if the calcium carbonate did not react with the dye so that the improvement of waterproof properties was not as great as had initially been expected. There was also a disadvantage in that the dye penetrated the paper so that optical density decreased.

As a result of intensive studies on lightly-coated paper suitable both for ink jet recording and electrophotography transfer, the inventors found that when silicic acid salts were used as fillers in the paper, and a specific amount of recording layer comprising synthetic silica and a binder was provided, the paper could be used as an ink jet recording paper. Although the texture of ordinary paper was not lost, this paper gave satisfactory print quality even with waterproof inks and inks of low surface tension provided that the critical surface tension of the recording layer surface was kept within a specified range. In addition, when this paper was used as a transfer paper for electrophotography, the paper had excellent toner fixing properties and transport properties. The inventors also found that when the contact angle of the recording layer surface measured using water was 100°–120°, the paper gave a high recording density and satisfactory recording quality even when ink jet recording was performed using inks of low surface tension, and thereby arrived at the present invention.

SUMMARY OF THE INVENTION

It is therefore a first object of this invention to provide a recording paper having excellent drying properties and giving an excellent print quality even when using inks of low surface tension or waterproof inks.

It is a second object of this invention to provide a recording paper which is suitable not only as an ink jet recording paper, but also as a transfer paper for electrophotography.

The aforesaid objects of the invention are attained by a recording paper having a recording layer provided on at least one surface of a base paper, the principal components of this layer being synthetic silica and an aqueous binder and the amount of solids in the layer lying in the range 0.5–4.0 g/m$^2$ on each surface of the paper on which the recording layer is provided, wherein either the critical surface tension $\gamma_c$ of the recording layer surface lies in the range $32 \leqq \gamma_c \leqq 42$ dyne/cm or the contact angle measured using water is 100°–120°, or alternatively, the critical surface tension $\gamma_c$ of the recording layer surface lies in the range $32 \leqq \gamma_c 42$ dyne/cm and the contact angle measured using water is 100°–120°.

DETAILED DESCRIPTION OF THE INVENTION

According to this invention, the critical surface tension ($\gamma_c$) is measured by dropping 4 microliters (μl) of solutions of various surface tensions on the recording layer surface of a recording paper, measuring the contact angle of each drop using an automatic contact angle gauge after 0.5 seconds has elapsed, and making a Zisman plot of these contact angles.

There is no particular limitation on the water-based ink of low surface tension used in this invention, a suitable ink having a surface tension of 30–45 dyne/cm being chosen from among those used for ink jet recording known in the art.

The surface tension of the ink may easily be determined by an automatic surface tension meter.

In the context of this invention, the term waterproof ink is used to mean an ink (referred to hereinafter simply as ink) containing a water-soluble dye having at least one carboxyl group. Under alkaline conditions, dissociation is promoted so that the dye dissolves, however under relatively strong acidic conditions, the carboxyl group exists in the free form which is difficultly soluble. Such a dye dissolves in ink of relatively high pH, however after printing when the ink adheres to the paper surface, as the pH of the paper surface is relatively low, the dye is converted to the free acid and is therefore rendered difficultly soluble.

There is no particular limitation on the filler added to the base paper used in this invention, this filler being chosen as appropriate from any of the fillers known in the art. Examples of such fillers are talc, kaolin, illite, clay, calcium carbonate and titanium dioxide. When recording with waterproof inks, the use of silicic acid salt fillers such as talc, kaolin, illite and clay is however to be preferred from the viewpoint of preventing reaction with the dye in the ink leading to a change of color rendering properties of the dye, the formation of salts which are difficultly soluble in water, and the loss of print quality.

Kaolin is a naturally occurring substance represented by the formula $Al_4[Si_4O_{10}](OH)_8$, and the pH of a dispersed slurry of kaolin is in the vicinity of 5. Illite is a naturally occurring substance represented by the formula $K_{1.5}AL_4[Si_{6.5}AL_{1.5}]O_{20}(OH)_4$, and the pH of a dispersed slurry of illite is in the vicinity of 7. Consequently, neither kaolin nor illite has any effect on printing.

The amount of filler used normally lies in the range of 3–30 weight % in terms of its proportion in the paper. When calcium carbonate or titanium dioxide are used, the recording density often tends to decline due to their optical properties. In these cases, it is desirable either to reduce the proportion of filler in the paper to the extent that print-through does not occur, or to use these fillers in conjunction with other fillers. According to this invention, it is preferred either to use kaolin or illite alone or mixture of them.

However, emulsion type sizing agents comprising rosin rendered hydrophobic by modification are preferably used in the present invention. Such an internal sizing agent is used in an amount of from 0.1 to 0.7 part by weight per 100 parts by bone dry weight of pulp.

There is no particular limitation on the pigment used for the recording layer of the recording paper according to this invention provided that it is a water-absorbing pigment. The use of amorphous silica which has a relatively large specific surface area is to be preferred. The amorphous silica referred to herein is the white carbon and amorphous silica referred to on p. 267 of the Applied Chemistry Section of the Chemical Handbook (Kagaku Binran Oyou Kagaku Hen) by the Chemical Society of Japan, published on 15 Oct. 1986 by Maruzen K. K. The amorphous silica obtained from gas phase is especially desirable.

The aqueous binder used in the recording layer according to this invention is preferably a water-based resin or emulsion which has a strong binding power to the pigment and base paper, and does not cause blocking between sheets of paper.

The amount of aqueous binder used preferably lies in the range of 10–100 weight parts with respect to 100 weight parts of pigment, and more preferably in the range of 10–50 weight parts.

Specific examples of the aqueous binder are polyvinyl alcohol, starches such as oxidized starch, esterified starch, enzyme-denatured starch and cationic starch, casein, soybean protein, cellulose derivatives such as carboxymethylcellulose and hydroxyethylcellulose, styrene/acrylic resins, isobutylene/maleic anhydride resin, acrylic emulsions, vinyl acetate emulsion, vinylidene chloride emulsion, polyester emulsion, styrene/butadiene latex and acrylonitrile/butadiene latex. These may either be used alone, or two or more may be used in conjunction.

The recording layer of this invention may be provided on one surface or both surfaces of the base paper. When it is used for ink jet recording, it prevents decrease of ink absorption due to sizing reinforcement without losing the texture of ordinary paper, and when used for electrophotography, it gives a paper which not only has excellent toner fixing properties but also excellent transport characteristics.

From this viewpoint, the critical surface tension ($\gamma_c$) of the recording layer surface lies preferably in the range $32 \leqq \gamma_c \leqq 42$ dyne/cm, and particularly preferably in the range 35–40 dyne/cm.

In this case, satisfactory print quality is obtained even when ink jet recording is performed using ink having a surface tension in the range of 30–45 dyne/cm which has recently come into use, while good toner fixing properties and transport properties are obtained when the paper is used as a transfer paper for electrophotography.

In order to obtain satisfactory ink drying properties and recording quality when ink jet recording is performed using a water-based ink having a surface tension lying in the range of 30–45 dyne/cm, it is preferred that the contact angle of the surface of the recording layer of this invention measured using water, lies in the range of 100°–120°, and from the viewpoint of ink drying properties, particularly preferred that this contact angle lies in the range of 100°–115°.

When the contact angle is greater than 120°, penetration of the ink in the recording layer is slow which causes smudging of the recorded image, on the other hand when the contact angle is less than 100°, the spreading of ink in the recording layer surface is too great which causes leathering and decreases recording quality.

The contact angle measured using water referred to herein, is the contact angle measured according to JIS K 3211 when 5 seconds has elapsed after distilled water at 20° C. has been dripped on the recording layer surface. This contact angle may be measured using an automatic contact angle gauge.

According to this invention, in order to effectively adjust the contact angle measured using water, it is desirable to use a small quantity of an additive, in particular a silicone-based water repellent. When this silicone-based water repellent is used in conjunction with a sizing agent, the contact angle of the recording layer surface may be adjusted more easily. Specific examples of silicone-based water repellents are dimethylsilicone, epoxy-modified silicone, carboxyl-modified silicone and polyethyl-modified silicone.

From the viewpoint of adjusting the contact angle of water or the critical surface tension of the recording layer, it is desirable that the recording layer of this invention comprises a sizing agent.

Examples of such sizing agents are higher fatty acids, styrene/acrylic resin, styrene/maleic acid, polyacrylamide, petroleum-based and silicone-based sizing agents.

The amounts of these water repellents and sizing agents used are suitably determined so as to obtain a desired contact angle or the critical surface tension of the recording layer.

From the viewpoint of conferring waterproof properties on the recording layer of this invention, the layer may also comprise a cationic water-soluble polymer.

Examples of such cationic water-soluble polymers are the quartenary ammonium salt derivative of polyethyleneimine, polyamide epichlorohydrin resin, cationic polyvinylcohol and cationic starch. These polymers may either be used alone, or two or more may be used in conjunction.

The amount of these cationic water-soluble polymers used is suitably determined within such limits that the advantages of this invention are not lost.

The coating color used to provide this recording layer is prepared by blending and dispersing the aforesaid pigment and binder with water.

From the viewpoint of obtaining a satisfactory print quality when using waterproof inks, it is desirable to add suitable salts so as to adjust the pH of the paper surface after coating to within the range of 5.5–7.5. The pH may be adjusted also by adjusting the pH of the pulp slurry used to make the base paper.

When the pH is less than 5.5, color rendering properties, especially when using phthalocyanin type cyan inks, deteriorate when the pH is higher than 7.5, waterproof properties or print density of printed articles may decline.

Suitable pH regulators, pigment dispersants, water retention agents, thickeners, antifoaming agents, preservatives, coloring agents, waterproofing agents, wetting agents, iluorescent dyes or ultraviolet absorption agents may also be added as necessary to the coating color used for the recording layer.

These additives may be chosen from among the various additives known in the art.

In order to obtain satisfactory recording properties and the same texture as that of ordinary paper, the amount of solids in the recording layer of this invention lies preferably within the range of 0.5–4.0 g/m$^2$, and more preferably within the range of 0.7–2.5 g/m$^2$, on each surface of the paper on which the recording layer is formed. When the recording layer contains less than 0.5 g/m$^2$, the ink tends to cause feathering, and bleeding of ink increases at the interface between colors when ink jet recording is performed.

When on the other hand, the amount of solids in the recording layer exceeds 4.0 g/m$^2$, separation of pigments such as synthetic silica increases so that the ink ejection nozzle of printers tends to clog when ink jet recording is performed. In addition, the surface feels powdery to the touch so that the texture of ordinary paper is not obtained.

The recording layer may be applied to one surface or both surface of a base paper as necessary using any coating method known in the art such as a size press, blade coating, roll coating, air knife coating or bar coating. From the viewpoint of operating efficiency and manufacturing cost, however, it is desirable to use size press coating which can coat both surfaces of the paper simultaneously in a continuous process. Although the recording paper of this invention is a paper having a light coating, it has excellent ink drying properties and gives excellent print quality even when ink jet recording is performed using low surface tension inks or waterproof inks. Moreover, when used as an electrophotography transfer paper, it has excellent toner fixing properties and paper transport characteristics.

EXAMPLES

This invention will now be described in further detail with reference to specific examples, however it shall be understood that these examples are not be construed as limiting the invention in any way. The tests, measurement methods and reference standards used in the examples and comparative examples are as described hereinbelow.

(1) Critical surface tension

The critical surface tension ($\gamma_c$) was found by measuring contact angle 0.5 seconds after allowing 4 microliters (μl) each of liquids of various surface tensions to drip down the surface of a recording layer of a recording paper, using an automatic contact angle meter (Model CA-Z, Kyowa Kaimen Kagaku Co., Ltd.), and drawing a Zisman plot from the contact angle.

(2) Evaluation of print quality

Printing was performed with black ink using a bubble jet color printer (BJC-400J, Canon Inc.), and print quality was visually evaluated according to the following criteria:

| | |
|---|---|
| a) Color rendering properties | |
| 1. No change of color rendering properties | o |
| 2. Change of color rendering properties found | x |
| b) Smudging | |
| 1. Almost no smudging | o |
| 2. Smudging evident | x |

(3) Transport properties

Copying was performed using a copying machine (Vivace 400, Fuji Xerox Co., Ltd.), an examination was made for evidence of paper sticking or faulty paper transport, and paper transport properties were evaluated according to the following criterion:

| | |
|---|---|
| 1. No problem of paper transport | o |
| 2. Paper transport has problems | x |

(4) Textural properties (ordinary paper texture)

The sensory test by the touch is carried out, and thereby the texture is evaluated in accordance with the following criterion:

| | |
|---|---|
| 1. The touch is similar to that of plain paper. | o |
| 2. The touch is akin to that of a coated paper. | x |

(5) Contact angle measured using water

Distilled water at 20° C. was dripped over the surface of the recording layer, and the contact angle of the water after 5 seconds had elapsed was measured using an automatic contact angle meter (Model CA-Z, Kyowa Kaimen Kagaku Co., Ltd.) according to JIS K 3211.

(6) Evaluation of print quality

A predetermined pattern was recorded using a bubble jet printer (BJC-400J, Canon Inc.), the recording density of the image part measured as described hereinbelow, and print quality evaluated according to the following criteria.

The surface tension at 20° C. of the ink used in this printer, measured using an automatic surface tension meter (PD-Z, Kyowa Kaimen Kagaku Co., Ltd.), was 43 dyne/cm for black and 33.8 dyne/cm for cyan.

a) Measurement of recording density:

The density of a fully printed recording area was measured using a Macbeth RD514.

b) Thickening of Printed Letters:

The printed letters is evaluated by visual observation in accordance with the following criterion;

| | |
|---|---|
| o | Printed letters are clear, so it is easy to read them. |
| x | Some thickening is caused in printed letters, so it is somewhat difficult to read them, or printed letters are considerably thickened, so it is difficult to read them. |

c) Spread of Ink:

The feather-form spread of ink is evaluated by visual observation in accordance with the following criterion;

| | |
|---|---|
| o | There is no spread of ink in feather forin. |
| x | There is some spread of ink in feather form, or there is much spread of ink in feather form. |

d) Ink drying properties:

The image part was touched with the fingers immediately after recording, and the degree of smudging evaluated according to the following criterion;

| | |
|---|---|
| o | No smudging |
| x | Slight smudging or severe smudging |

e) Water resistance:

The recording paper with recorded images is soaked in water for 15 minutes, and then dried spontaneously. The resulting images are evaluated by visual observation in accordance with the following criterion;

| | |
|---|---|
| o | No change is observed in the images. |
| x | Part of the images is blurred, or most of the image-forming ink has drained away. |

EXAMPLE 1

90 weight parts of LBKP (Hardwood Bleached Sulphate Pulp) (c.s.f. 350 ml), 10 weight parts of kaolin as paper filler, 1 part of cationized starch and 0.2 weight parts of a hydrophobic modified rosin emulsion sizing agent were blended together, and an ink jet recording paper of weighting 81.4 g/m$^2$ was manufactured using a Fourdrinier paper machine. The following coating color was then applied to the surface of the base paper using a gate roller.

COATING SOLUTION (COLOR)1

100 weight parts of amorphous silica as pigment (Aerosil 100, Nippon Aerosil Co., Ltd.) was dispersed in 800 parts of water. With the dispersion obtained were blended 40 weight parts of polyvinyl alcohol (PVA117, Kuraray CO., Ltd.) dissolved in 530 weight parts of water as aqueous binder, 14 weight parts of a sizing agent (BLS-720, Misawa Ceramic Chemical Co., Ltd.), and 20 weight parts of a cationic polymer electrolyte (Dyefix YK-50, Daiwa Chemical Industries Ltd.) so as to obtain a coating solution.

The coating amount on the recording paper obtained was 2.0 g/m$^2$ in terms of solids on each surface and 4.0 g/m$^2$ in terms of solids on both surfaces of the paper.

The measurement of pH of the paper surface and evaluation of color rendering properties of this paper are as shown in Table 1.

EXAMPLE 2

A recording paper was prepared in exactly the same way as that of Example 1 excepting that 5 weight parts of a silicone-based water repellent (SM7060, Toray Dow Corning Silicone Co., Ltd.) was used instead of the 14 weight parts of sizing agent (BLS-720) used in the coating solution of Example 1. Also the coating amount was 2.3 g/m$^2$ in terms of solids on each surface and 4.6 g/m$^2$ in terms of solids on both surfaces of the paper. The results of measurements and evaluations performed exactly as in Example 1, are shown in Table 1.

EXAMPLE 3

A recording paper was prepared in exactly the same way as that of Example 1 excepting that illite was used instead of kaolin for preparing the base paper, and 3 weight parts of a silicone-based water repellent (SM7060) was used instead of the 14 weight parts of sizing agent (BLS-720) used in the coating solution, of Example 1. Also the coating amount was 1.7 g/m$^2$ in terms of solids on each surface and 3.4 g/m$^2$ in terms of solids on both surfaces of the paper. The results of measurements and evaluations performed exactly as in Example 1, are shown in Table 1.

EXAMPLE 4

A recording paper was prepared in exactly the same way as that of Example 3 excepting that 10 weight parts of a sizing agent (Basoplast 250D, BASF Japan Ltd.) was used instead of 3 weight parts of a silicone-based water repellent (SM7060). Also the coating amount was 2.8 g/m$^2$ in terms of solids on each surface and 5.6 g/m$^2$ in terms of solids on both surfaces of the paper. The results of measurements and evaluations performed exactly as in Example 3, are shown in Table 1.

Comparative Example 2

A recording paper was prepared in exactly the same way as that of Example 4 excepting that 6 weight parts of sizing agent was used instead of 10 weight parts of sizing agent to prepare the coating solution. Also the coating amount was 2.5 g/m$^2$ in terms of solids on each surface and 5.0 g/m$^2$ in terms of solids on both surfaces of the paper. The results of measurements and evaluations performed exactly as in Example 4, are shown in Table 1.

Comparative Example 3

A recording paper was prepared in exactly the same way as that of Example 1 excepting that 17 weight parts of sizing agent was used instead of 14 weight parts of sizing agent to prepare the coating solution. Also the coating amount was 2.1 g/m$^2$ in terms of solids on each surface and 4.2 g/m$^2$ in terms of solids on both surfaces of the paper. The results of measurements and evaluations performed exactly as in Example 1, are shown in Table 1.

Comparative Example 4

A recording paper was prepared exactly as in Example 1 excepting that the coating solution was not applied. The results of measurements and evaluations performed exactly as in Example 1, are shown in Table 1.

TABLE 1

| | Filler | Water repellent | Coverage* g/m$^2$ | Critical surface tension dyne/cm | Print qualities: Color rendering properties | Smudging | Travelling Properties | Texture |
|---|---|---|---|---|---|---|---|---|
| Example 1 | kaolin | sizing agent | 2.0 | 33 | ○ | ○ | ○ | good |
| Example 2 | kaolin | silicone | 2.3 | 36 | ○ | ○ | ○ | good |
| Example 3 | illite | silicone | 1.7 | 39 | ○ | ○ | ○ | good |
| Example 4 | illite | sizing agent | 2.8 | 41 | ○ | ○ | ○ | good |
| Example 5 | kaolin | sizing agent | 0.7 | 34 | ○ | ○ | ○ | good |
| Compar. Ex. 1 | $CaCo_3$ | sizing agent | 1.8 | 33 | X | ○ | ○ | good |
| Compar. Ex. 2 | illite | sizing agent | 2.5 | >44 | ○ | X | ○ | good |
| Compar. Ex. 3 | kaolin | sizing agent | 2.1 | <30 | ○ | ○ | X | good |
| Compar. Ex. 4 | kaolin | — | — | >50 | ○ | X | ○ | good |

*per side, solids basis.

EXAMPLE 5

A recording paper was prepared in exactly the same way as that of Example 1 excepting that the coating amount was 0.7 g/m$^2$ in terms of solids on each surface and 1.4 g/m$^2$ in terms of solids on both surfaces of the paper. The results of measurements and evaluations performed exactly as in Example 1, are shown in Table 1.

Comparative Example 1

A recording paper was prepared in exactly the same way as that of Example 1 excepting that 10 weight parts of calcium carbonate was used instead of the 10 weight parts of kaolin used in Example 1, and the coating amount was 1.8 g/m$^2$ in terms of solids on each surface and 3.6 g/m$^2$ in terms of solids on both surfaces of the paper. The results of measurements and evaluations performed exactly as in Example 1, are shown in Table 1.

EXAMPLE 6

To 100 parts of absolutely dry pulp in a pulp slurry prepared from hardwood bleached sulphate pulp (L-BKP) of Canadian Standa Freeness 450 ml, 7 parts of kaolin, 1.0 part of aluminum sulfate, 1 part of cationic starch, 0.1 part of sizing agent and 0.02 parts of retention aid were added to make a paper sample in a twin wire paper machine. At the same time, the coating solution 2 below was coated on both surfaces of this paper in a size press so that the coating amount was 0.7 g/m$^2$ in terms of solids on each surface, so as to obtain an ink jet recording paper of weighting 82 g/m$^2$.

COATING COMPOSITION 2:

| | |
|---|---|
| 1 Synthetic silica [Finesil (specific surface area: 270 $m^2/g$), trade name, a product of Tokuyama Corp.] | 100 parts |
| 2. Water-base binder [Polyvinyl alcohol, Kuraray 117, trade name, a product of Kuraray Co., Ltd.] | 25 parts |
| 3. Cationic water-soluble polymer [PCL-1, trade name, a product of Senka Corporation.] | 30 parts |
| 4. Silicone-based water repellent [Polon MWS, a product of Shin-Etsu Chemical Co., Ltd.] | 2 Parts |
| 5. Anti-foaming agent [Foamaster AP, trade name, a product of San Nopco Limited.] | 0.05 part |

EXAMPLE 7

An ink jet recording paper was prepared in exactly the same way as that of Example 6 excepting that 14 parts of kaolin were used instead of the 7 parts used in Example 6, 4 parts of silicone-based water repellent were used instead of the 2 parts used in coating solution 2, and the coating amount was 2.0 $g/m^2$ in terms of solids on each surface of the paper.

EXAMPLE 8

An ink jet recording paper was prepared in exactly the same way as that of Example 6 excepting that 14 parts of kaolin were used instead of the 7 parts used in Example 6, the coating solution 3 below was used instead of coating solution 2, and the coating amount was 3.8 $g/m^2$ in terms of solids on each surface of the paper.

COATING COMPOSITION 3:

| | |
|---|---|
| 1. Synthetic silica [Aerozil (specific surface area: 200 $m^2/g$), trade name, a product of Nippon Aerosil Co. Ltd.] | 10.0 parts |
| 2. Water-base binder [Polyvinyl alcohol, Kuraray 105, trade name, a product of Kuraray Co., Ltd.] | 20 parts |
| 3. Cationic water-soluble polymer [PCL-1, trade name, a product of Senka Corporation.] | 25 parts |
| 4. Silicone-based water repellent [TSW831, a product of Toshiba Silicone Co., Ltd.] | 4 Parts |
| 5. Sizing agent (NC size-C 40, a product of Nicca Chemical Co., Ltd] | 4 parts |
| 6. Anti-foaming agent [Foamaster AP, trade name, a product of San Nopco Limited.] | 0.05 part |

EXAMPLE 9

An ink jet recording paper was prepared in exactly the same way as that of Example 8 excepting that the silicone-based water repellent used in coating solution 3 was not used, 19 parts of sizing agent were used, and the coating amount was 2.0 $g/m^2$ in terms of solids on each surface of the paper.

Comparative Example 5

An ink jet recording paper was prepared in exactly the same way as that of Example 7 excepting that the amount of silicon-based water repellent used was changed from 4 parts to 9 parts.

Comparative Example 6

An ink jet recording paper was prepared in exactly the same way as that of Example 7 excepting that 5 parts of a sizing agent (Basoplast 250D, BASF Japan Ltd.) were used instead of the silicone-based water repellent used in coating solution 2 of Example 7.

Comparative Example 7

An ink jet recording paper was prepared in exactly the same way as that of Example 7 excepting that the silicone-based water repellent in coating solution 2 of Example 7 was not used.

Comparative Example 8

An ink jet recording paper was prepared in exactly the same way as that of Example 8 excepting that the coating amount was 4.5 $g/m^2$ in terms of solids on each surface of the paper.

Comparative Example 9

An ink jet recording paper was prepared in exactly the same way as that of Example 8 excepting that the coating amount was 0.3 $g/m^2$ in terms of solids on each surface of the paper.

Tests of the ink jet recording papers obtained in the examples and comparative examples, and the results therefrom, are summarized in Table 2. The aforesaid results confirm the efficacy of this invention.

TABLE 2

| | Filler | Water repellent | Coverage $g/m^2$ | contact angle | recording density black/cyan | Thickening of Printed Letters black/cyan | Spread of Ink black/cyan | Ink drying properties black/cyan | Water resistance black/cyan | Texture |
|---|---|---|---|---|---|---|---|---|---|---|
| Example 6 | kaolin | silicone | 0.7 | 103 | 1.23/1.16 | ○/○ | ○/○ | ○/○ | ○/○ | ○ |
| Example 7 | kaolin | silicone | 2.0 | 114 | 1.25/1.18 | ○/○ | ○/○ | ○/○ | ○/○ | ○ |
| Example 8 | illite | silicone/sizing agent | 3.8 | 118 | 1.30/1.20 | ○/○ | ○/○ | ○/○ | ○/○ | ○ |
| Example 9 | illite | sizing agent | 2.0 | 105 | 1.20/1.14 | ○/○ | ○/○ | ○/○ | ○/○ | ○ |
| Compar. Ex. 5 | kaolin | silicone | 2.0 | >125 | 1.10/1.05 | ○/○ | ○/○ | X/X | X/X | ○ |
| Compar. Ex. 6 | kaolin | sizing agent | 2.0 | <60 | 1.15/1.10 | X/X | X/X | ○/○ | ○/○ | ○ |
| Compar. Ex. 7 | kaolin | — | 2.0 | <30 | 1.18/1.12 | X/X | ○/○ | ○/○ | ○/○ | ○ |
| Compar. Ex. 8 | illite | silicone/sizing agent | >4.5 | 117 | 1.28/1.18 | ○/○ | ○/○ | ○/○ | ○/○ | X |
| Compar. Ex. 9 | illite | silicone/sizing agent | <0.3 | 110 | 1.15/1.10 | ○/○ | X/X | ○/○ | X/X | ○ |

What is claimed:

1. A recording paper having a recording layer comprising synthetic silica and an aqueous binder as its principal components, said layer being formed on at least one surface of a base paper and the amount of said layer lying within the range of 0.5–4.0 g/m$^2$ in terms of solids on each surface on which said layer is formed, wherein the critical surface tension of said recording layer surface ($\gamma_c$) lies within the limits $43 \leqq \gamma_c \leqq 42$ dyne/cm and, optionally, the contact angle measured using water lies in the range of 100–120°.

2. A recording paper as defined in claim 1 wherein said base paper further comprises mainly silicic acid fillers.

3. A recording paper as defined in claim 2 wherein said synthetic silica is a silica manufactured by a vapor phase method.

4. A recording paper as defined in claim 1 wherein said synthetic silica is a silica manufactured by a vapor phase method.

5. A recording paper as defined in claim 1 whereof the contact angle measured using water is 100°–120°.

6. A recording paper as defined in claim 5 wherein said base paper further comprises a filler and a sizing agent.

7. A recording paper as defined in claim 6 wherein said recording layer further comprises a silicone-based water repellent.

8. A recording paper as defined in claim 7 wherein said recording layer further comprises a sizing agent.

9. A recording paper as defined in claim 8 wherein said recording layer further comprises a silicone-based water repellent.

10. A recording paper as defined in claim 9 wherein said synthetic silica is a silica manufactured by a vapor phase method.

11. A recording paper as defined in claim 7 wherein mainly silicic acid salt fillers are used for said filler.

12. A recording paper as defined in claim 6 wherein said recording layer further comprises a sizing agent.

13. A recording paper as defined in claim 12 wherein mainly silicic acid salt fillers are used for said filler.

14. A recording paper as defined in claim 6 wherein mainly silicic acid salt fillers are used for said filler.

15. The recording paper of claim 1, wherein the critical surface tension is from 35–40 dyne/cm.

16. The recording paper of claim 1, wherein the contact angle measured using water is from 100°–115°.

* * * * *